US006311517B1

(12) United States Patent
Rampp et al.

(10) Patent No.: US 6,311,517 B1
(45) Date of Patent: Nov. 6, 2001

(54) APPARATUS AND PROCESS FOR FRACTIONATING A GAS MIXTURE AT LOW TEMPERATURE

(75) Inventors: Augustin Rampp, Iffeldorf; Manfred Sotzek, München, both of (DE)

(73) Assignee: Linde Aktiengesellschaft, Wiesbaden (DE)

( * ) Notice: Subject to any disclaimer, the term of this patent is extended or adjusted under 35 U.S.C. 154(b) by 0 days.

(21) Appl. No.: 09/528,103

(22) Filed: Mar. 17, 2000

(30) Foreign Application Priority Data

Mar. 17, 1999 (DE) ..... 199 11 909
Jul. 9, 1999 (EP) ..... 99113350

(51) Int. Cl.[7] ..... F25J 3/00; F25J 5/00
(52) U.S. Cl. ..... 62/643; 62/903
(58) Field of Search ..... 62/643, 646, 903

(56) References Cited

U.S. PATENT DOCUMENTS

| | | | | |
|---|---|---|---|---|
| 3,578,073 | * | 5/1971 | Bosquain | 165/111 |
| 4,599,097 | * | 7/1986 | Petit et al. | 62/903 |
| 5,144,809 | | 9/1992 | Chevalier et al. | 62/36 |
| 5,275,004 | * | 1/1994 | Agrawal et al. | 62/643 |
| 5,321,954 | * | 6/1994 | Lehman et al. | 62/903 |
| 5,324,452 | | 6/1994 | Allam et al. | 252/373 |
| 5,765,631 | | 6/1998 | Gerard | 165/166 |
| 5,901,578 | | 5/1999 | Wong et al. | 62/646 |

FOREIGN PATENT DOCUMENTS

| | | |
|---|---|---|
| 0 407 136 | 1/1991 | (EP) . |
| 2 238 132 | 7/1973 | (FR) . |
| 10-206012 | 8/1998 | (JP) . |

* cited by examiner

*Primary Examiner*—William Doerrler
(74) *Attorney, Agent, or Firm*—Crowell & Moring LLP

(57) ABSTRACT

An apparatus for fractionating a gas mixture at low temperature includes (1) a separation column; (2) a heat-exchanger block comprising a main heat-exchanger section and a condenser/evaporator section, wherein the condenser/evaporator section has evaporation passages and condensation passages; (3) a first feed gas line for supplying feed gas to the main heat-exchanger section; (4) a second feed gas line for introducing cooled feed gas into the separation column; (5) a first liquid line leading from a lower region of the separation column to an inlet of the evaporation passages; (6) a gas line that leads from an upper region of the separation column to the condensation passages; (6) a reflux line to introduce condensate which is formed in the condensation passages into the upper region of the separation column; (7) a phase-separation device connected to an outlet of the evaporation passages; and (8) a second liquid line leading from the phase-separation device to an inlet of the evaporation passages and also connected to a purge line.

11 Claims, 3 Drawing Sheets

APPARATUS AND PROCESS FOR FRACTIONATING A GAS MIXTURE AT LOW TEMPERATURE

BACKGROUND AND SUMMARY OF INVENTION

This application claims the priority of German patent document 199 11 909.0, filed Mar. 17, 1999, and European patent document EP 99113350.5, filed on Jul. 9, 1999, the disclosures of which are expressly incorporated by reference herein.

The present invention relates to an apparatus for fractionating a gas mixture at low temperature comprising (1) a separation column; (2) a heat-exchanger block, which possesses a main heat-exchanger section and a condenser/evaporator section, wherein the condenser/evaporator section has evaporation passages and condensation passages; (3) a first feed gas line for supplying feed gas to the main heat-exchanger section; (4) a second feed gas line, for introducing cooled feed gas into the separation column; (5) a first liquid line which leads from the lower region of the separation column to the inlet of the evaporation passages; (6) a gas line which leads from the upper region of the separation column to the condensation passages; and (7) a return line to introduce condensate which is formed in the condensation passages into the upper region of the separation column.

The most important area of application of the present invention is the low-temperature fractionation of air in single- or multiple-column processes, especially the production of nitrogen from air in a single-column process. "Separation column" is here taken to mean a conventional mass-transfer column which comprises rectification plates, packing (random packing) and/or arranged packing as mass-transfer elements, in particular a rectification column or a distillation column.

In FIG. 3 of JP-A-10206012, the main heat exchanger and condenser/evaporator are not formed, as is generally customary, by separate heat-exchanger blocks, but are integrated in one heat exchanger block which has one main heat-exchanger section for cooling air against return streams and one condenser/evaporator section for producing return liquid by vaporizing the bottoms liquid of the separation column. This integrated type of construction has the advantage of lower plant costs in comparison with conventional plants.

The liquid which is vaporized in the heat-exchanger block of the plant in accordance with JP-A-10206012, in addition to comprising the main components oxygen, nitrogen and argon, also comprises those air constituents that are less volatile than oxygen and that are not removed from the feed air during the air purification upstream of the main heat-exchanger section. During the vaporization of the oxygen-enriched bottoms liquid from the separation column in the heat exchanger block according to JP-A-10206012, there is the risk that some of these less volatile constituents do not vaporize completely but accumulate in the liquid which is present in the condenser/evaporator section. In the event of such accumulations, for example of hydrocarbons, a great safety risk would be expected. Interruptions to operations to remove the less volatile components from the condenser/evaporator section would make continuous long-term operation of the plant impossible. This would mean a high operating expenditure and significant losses of production. Therefore, in practice, the use of such integrated heat exchangers has been avoided.

The object underlying the present invention is to provide an apparatus of the type mentioned at the outset and a corresponding process which are more expedient to operate, in particular in a particularly safe and economical manner.

This object is achieved by a phase-separation device that is connected on one side to the outlet of the evaporation passages and on the other side to a second liquid line which leads from the phase-separation device to the inlet of the evaporation passages and in addition has a connection to a purge line.

The apparatus of the present invention makes possible reliable operation of the integrated heat-exchanger block without interruption to operations. The liquid is only partially vaporized in the condensor/evaporator section and the resultant vapor is separated in the phase-separation device from the proportion that has remained in the liquid state. One part of the proportion that has remained in the liquid state is returned via the second liquid line to the inlet of the evaporation passages of the condenser/evaporator section and a second part is discarded continuously or batchwise via a purge line.

Dividing the proportion which has remained in the liquid state from the phase-separation device which, in the case of air fractionation is enriched with less volatile components, prevents an unwanted concentration. It is thus possible to eject less volatile impurities and to keep their content in the evaporation passages within a safe limiting value (for example, below 500 ppm $CH_4$ equivalents). For example, the proportion of the liquid discarded via the liquid line is seven to 15 times, preferably eight to ten times, the amount vaporized in the evaporation passages (the relative amounts relate here and hereinafter to molar amounts). The purge amount discarded via the purge line is, for example, from 0.05 to 0.5%, preferably from 0.1 to 0.2%, of the total amount of gas mixture to be fractionated.

The heat-exchanger block is formed in the present invention preferably by a plate heat exchanger, especially by a brazed aluminum plate heat exchanger. In this case, the main heat-exchanger section is preferably situated above the condenser/evaporator section.

Generally, in the apparatus according to the present invention, only a single heat-exchanger block is used. This can be, for example, fabricated in one piece or can be manufactured by joining together (for example by flanges) two or more sections. However, the invention can also be applied to larger plants by connecting two or more such heat-exchanger blocks in parallel. Each of these heat-exchanger blocks then has both a main heat-exchanger section and a condenser/evaporator section.

The main area of application of the present invention is in single-column plants in which the condenser/evaporator section is preferably the top condenser of the single separation column. However, the invention is also applicable in principle to other processes having two or more columns; for example, the main condenser of a double-column plant can be formed by the condenser/evaporator section.

The phase-separation device can be implemented in various manners. First, the phase-separation device can be formed by a vessel disposed outside the heat-exchanger block, which vessel is connected via a line to the outlet of the evaporation passages. In a second example, the phase-separation device is formed by a collector in the form of a header disposed laterally at the heat-exchanger block; alternatively thereto, a corresponding header can be disposed on both sides of the heat-exchanger block. "Header" is taken to mean a distribution device or collection device which is flow-connected to a defined group of passages of a heat-exchanger block and serves for the feed or take-off of fluid flowing through these passages. The headers mentioned here can be constructed, for example, to be of half-tube shape. In a third variant, the phase-separation device is formed by a region disposed within the heat-exchanger block in the transition between the condenser/evaporator section and the main heat-exchanger section.

For the construction of the liquid line also, there are various alternatives. The liquid line can be disposed outside the heat-exchanger block or be formed by passages within the heat-exchanger block. The second variant is suitable especially when the phase separation is carried out within the heat-exchanger block; for this there can be used, for example, the otherwise unused continuations of the passages for cooling the gas mixture to be fractionated, which passages are interrupted at the lower end of the main heat-exchanger section.

The vapor from the phase-separation device is preferably fed to the main heat-exchanger section at its cold end.

The heat-exchanger block used in the present invention can be used in any process and any plant in which a first fluid is cooled in a main heat-exchanger section and a second fluid is vaporized against a condensing third fluid in a condenser/evaporator section.

The passages for the gas from the upper region of the separation column (in the case of air fractionation, nitrogen) can pass without interruption through the entire length of the heat-exchanger block. In this case, the gas is introduced into the heat-exchanger block via the gas line in the transition region between the main heat-exchanger section and the condenser/evaporator section, wherein a part of the gas flowing upwards into the main heat-exchanger section is heated and taken off as product, another part flowing downwards into the condensation passages of the condenser/evaporator section is liquefied.

The passages for the fraction originating from the lower region of the separation column can be constructed continuously in a similar manner. In particular, if the phase-separation device is disposed within the heat-exchanger block, the vapor formed in the evaporation passages can flow through the main heat-exchanger section remaining in the same throughways.

Preferably, at least one group of passages of the heat-exchanger block is interrupted between main heat-exchanger section and condenser/evaporator section. If the heat-exchanger block is implemented as a brazed aluminum plate heat exchanger, the passages are interrupted by horizontally or obliquely disposed walls (closure strips, side bars), which are disposed in the transition region between main heat-exchanger section and condenser/evaporator section. Walls of this type can close off, for example, the passages for cooling the gas mixture to be fractionated on their lower side and/or the evaporation passages on their upper side. The vapor from the phase-separation device can be introduced into the continuation of the above closed-off evaporation passages in order to heat up in the main heat-exchanger section against feed gas to be cooled.

Preferably, the gas to be condensed is fed to the upper end of the condenser section and flows downwards concurrently with the condensate formed within the condensation passages.

The invention and other details of the invention are described in more detail below on the basis of two illustrative examples shown diagrammatically in the drawings. The examples relate to the production of gaseous nitrogen by low-temperature fractionation of air in single-column plant.

DETAILED DESCRIPTION OF THE DRAWINGS

Figure 1:
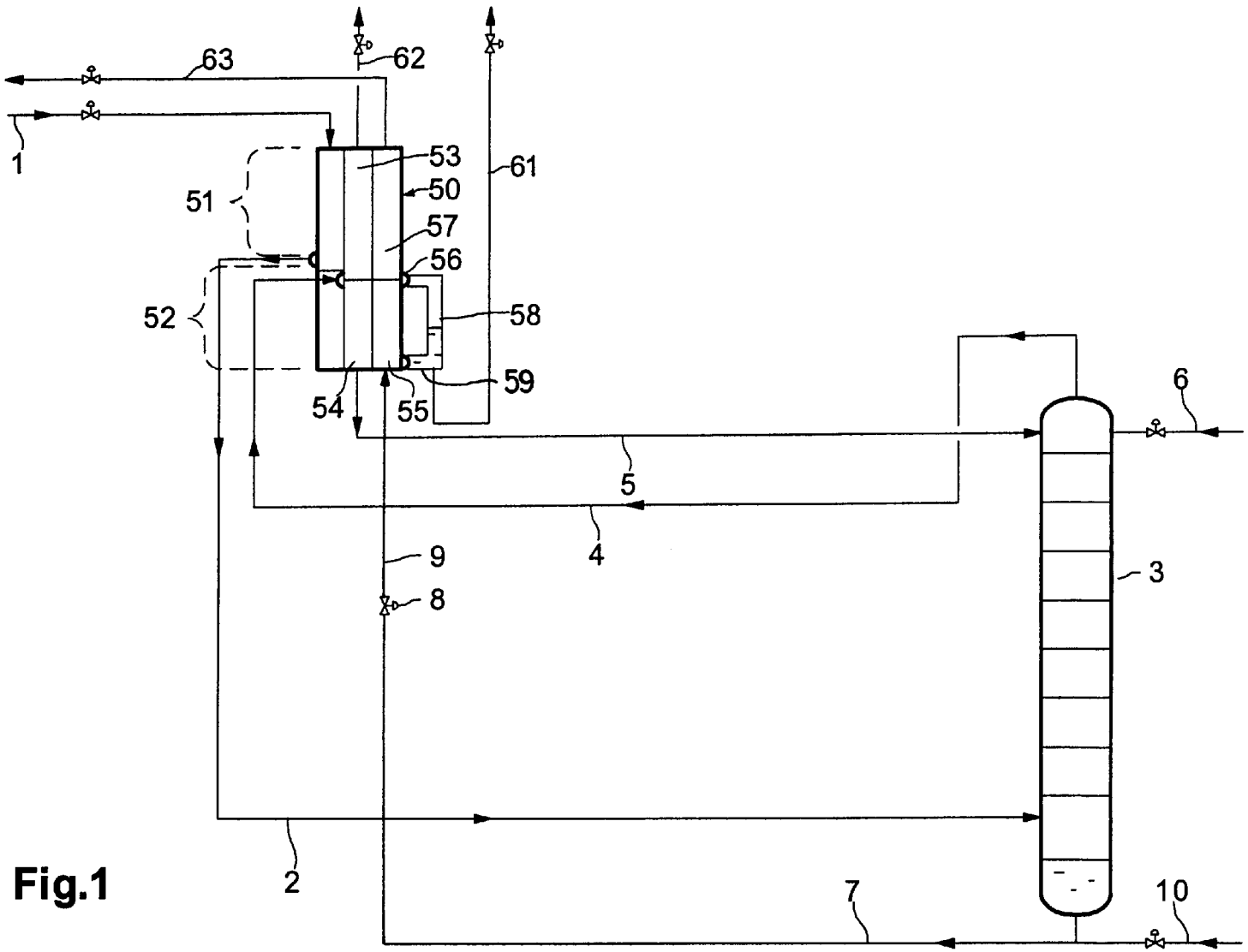
FIG. 1 shows a first illustrative example of the invention having supply of refrigeration by an external liquid.

Compressed and purified feed air 1 flows, in the example of FIG. 1, as gas mixture (feed gas) to be fractionated into the main heat-exchanger section 51 of a heat-exchanger block 50 which, in addition, has a condenser/evaporator section 52. In the main heat-exchanger section 51, the feed air is cooled to about dew point and thereafter fed via line 2 into the separation column 3.

Nitrogen 4 (the "first fraction") is taken off in the gaseous state overhead from separation column 3 and flows to the heat-exchanger block 50 in the transition between main heat-exchanger section 51 and condenser/evaporator section 52. As a result, a first part of the gaseous nitrogen is introduced upwards into the passages 53 of the main heat-exchanger section and is finally taken off via a product line 62. Another part of the nitrogen 4 flows downwards into the condensation passages 54 of the condenser/evaporator section, condensing at least in part, preferably essentially completely or completely. The condensate is recirculated via the reflux line 5 to the top of the separation column 3. A portion can, if needed, be withdrawn as liquid product (not shown).

An oxygen-enriched ("second") fraction 7 is taken off in the liquid state from the bottoms of separation column 3, expanded (8) and transported via line 9 to the lower end of the condenser/evaporator section 52. (The lines 7 and 9 form the "first liquid line".) The oxygen-enriched fraction is partially vaporized in the evaporation passages 55 of the condenser/evaporator section 52 of the heat-exchanger block 50. The evaporation passages 55 are closed at their upper end. There, the two-phase mixture from the evaporation passages 52 is collected in two laterally disposed headers 56, of which only one is shown in FIG. 1. The header 56 acts as a phase-separation device. The vapor portion is then returned to the heat-exchanger block, more precisely into the lower end of the main heat-exchanger section, the continuations 57 of the evaporation passages 55 being used for the heating. The portion which has remained in the liquid state is taken off outside the heat-exchanger block 50 via a liquid line 58, and at least in part 59, recirculated to the lower end of the evaporation passages, 55. Another part is discharged continuously or batchwise via the purge line 61.

Refrigeration to compensate for the insulation losses can be supplied to the plant by feeding liquid nitrogen via line 6 and/or a liquefied mixture of atmospheric gases and/or liquid oxygen via line 10 into the separation column 3 and/or into the evaporation passages 55 of the condenser/evaporator section 52, respectively. In the illustrative example of FIG. 1, internal generation of refrigeration by means of work-expansion of a turbine is dispensed with completely.

Figure 2:
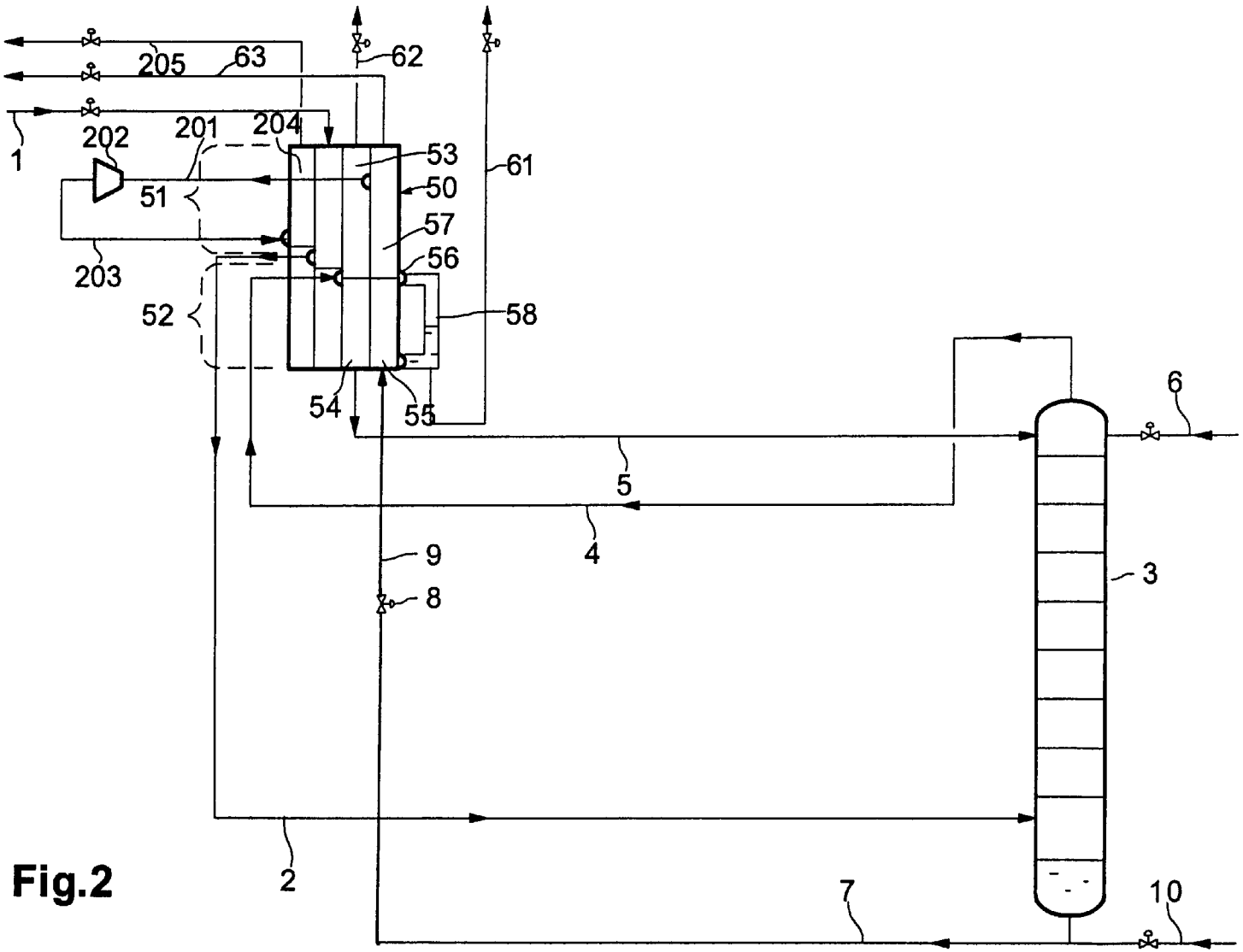
FIG. 2 shows a second illustrative example having generation of refrigeration by a turbine.

Alternatively, the process refrigeration can be produced entirely or partially by work-expansion of a process gas, as shown in FIG. 2.

For this purpose, a portion 201 of the residual gas produced in the vaporization 55 is taken off at an intermediate temperature from the heating passages 57 of the main heat-exchanger section 51 and work-expanded in a turbine 202. The expanded residual gas 203 is fed back to the main heat-exchanger section 51, more precisely in the vicinity of its cold end. In the additional passages 204, the expanded residual gas is finally heated to ambient temperature and drawn off (205).

Figure 3A:
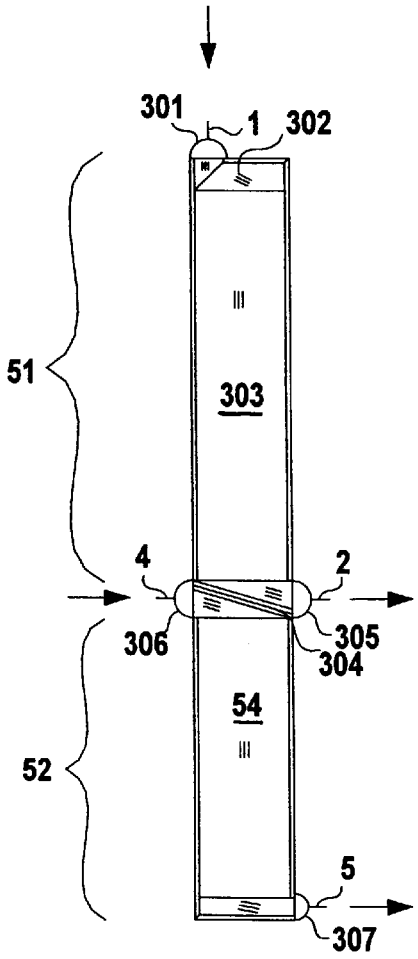
FIG. 3 shows the main heat-exchanger block of FIG. 1 in detail.
Figure 3B:
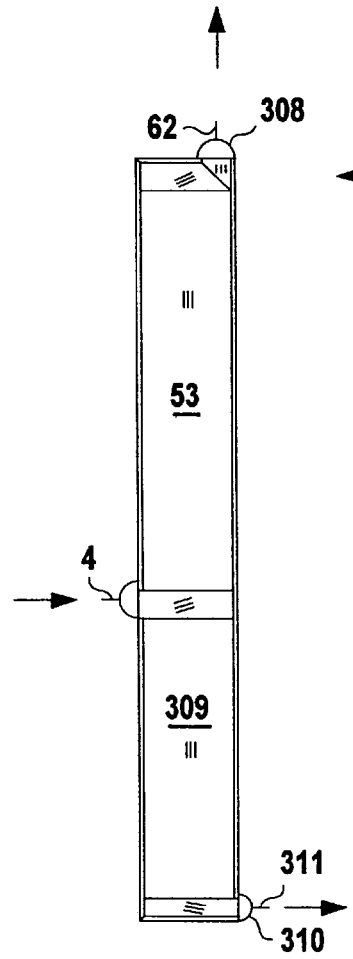
Figure 3C:
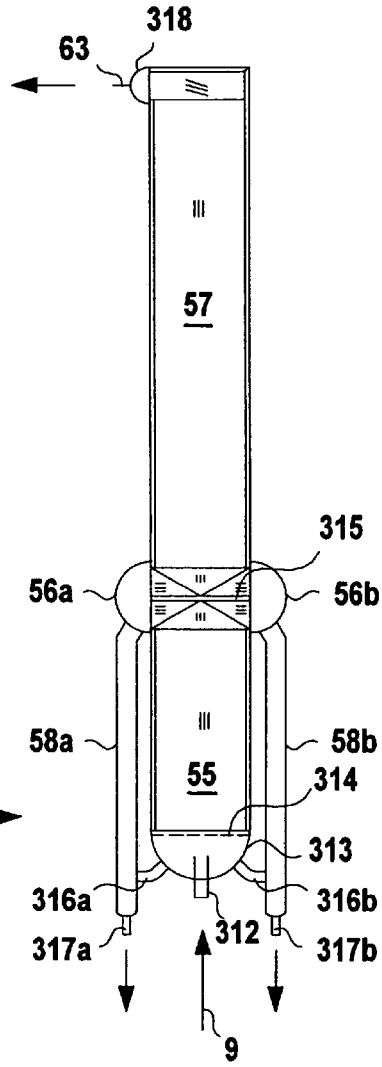

The internal structure of the heat-exchanger block 50 of the two illustrative examples can be seen in FIG. 3. The connection with FIG. 1 becomes clear, inter alia, from the reference numbers which are used jointly in both figures. FIG. 3 shows the three cross Sections A, B and C from which the heat-exchanger block 50 is made up:

cross section A comprises at the top a passage 303 for cooling feed air 1 and at the bottom a condensation passage 54.

cross section B at the top represents a passage 53 for heating nitrogen 4.

cross section C has in the bottom region an evaporation passage 55 and at the top a passage 57 for heating residual gas.

In the heat-exchanger block, in accordance with the customary construction of plate heat exchangers, a plurality of cross sections of type A, B and C are disposed alternately one after the other (in the sense of the plane of the drawing of FIG. 3). All passages of the respective type communicate at their top and bottom ends via externally mounted headers. (In the drawings of FIG. 3, only the headers are shown in each case which are flow-connected to the cross section depicted.)

The representation of FIG. 3 is not to scale. The height of the main heat-exchanger section 51 is in reality, for example, from 2 to 5 m, preferably about 3.5 m. The condenser section 52 is, for example, from 1 to 2 m, preferably about 3.5 m, high. Double lines in FIG. 3 denote closure strips (side bars) which seal off a depicted passage laterally, at the top or at the bottom. The preferred orientation of the corrugated plates (fins) disposed within the passages is shown in each case by a triplet of short lines.

Feed air 1 flows into the header 301, which is shown only in the left section of FIG. 3 (cross section A) By means of the inclined fins 302, the gas introduced is distributed over the entire width of the passage 303. At its bottom side, the air passages 303 are closed off by two inclined side bars 304. The cooled air is withdrawn via a header 305 and flows via line 2 to the separation column. On the other side of the double side bars 304, nitrogen from the gas line 4 is introduced via a further header 306 into the condensation passages 54. The condensate is taken off and at the bottom a passage 53 for heating at the bottom end via a header 307 and passed via the reflux line 5 to the top of the separation column.

The nitrogen header connected to the condensation passages of cross section A is also depicted in the middle section of FIG. 3 which shows a cross section of type B. This is because the header 306 also communicates with the passages 53 depicted there. The part of the nitrogen conducted via line 4 which does not flow into the condensation passages 54 flows into the passages 53 of the main heat exchanger section and is warmed there. The warm nitrogen gas is conducted via a header 308 to the product line 62. The lower continuation 309 of the passage 53, which is part of the condenser section, has, in the illustrative example, no function in the context of the heat exchanger process. Header 310 and header 311 only serve for venting the lower section of the passages B.

The cross sections C serve exclusively for treating the oxygen-enriched ("second") fraction 9 which originates from the bottom of the separation column. This is introduced via a connection part 312 as a two-phase mixture centrally into a header 313 which covers the entire lower side of the heat-exchanger block 50. A perforated plate 314 runs over the entire horizontal cross section of the header 313. The perforated plate serves for distributing the vapor bubbles present in the two-phase mixture over the entire horizontal cross section. Within the evaporation passages 55 the liquid-vapor mixture ascends upwards due to the thermosiphon effect and exits below the side bar 315 left or right into the two headers 56*a*, 56*b*, respectively, which act as a phase separation device. The vapor portion flows upwards into the main-heat exchanger section 52, more precisely into the continuation 57 of the evaporation passages 55 above the side bar 315. The warm gas is taken off via a header 318 to the residual gas line 63. The remaining liquid flows downwards in the tubes 58*a*, 58*b*, which form the "second liquid line", and for the most part via ports 316*a*, 316*b*, back into the header 313. A smaller part can flow via the ports 317*a*, 317*b* to the purge line shown in FIG. 1.

In the heat-exchanger block shown, the following measures in particular are of constructional interest:

the symmetrical construction of the introduction of the oxygen-enriched fraction via header 313 into the evaporation passages, the symmetrical take-off of the liquid-vapor mixture below the side bar 315 to the headers 56*a*, 56*b*, the use of perforated plate 314 for bubble distribution, and the introduction of the two-phase mixture 7 above the liquid from the liquid lines 58*a*, 58*b* (the upper edge of the central port 312 is above the upper edges of the lateral ports 326*a*, 316*b*).

Each of these measures causes on its own a particularly uniform flow through the evaporation passages 55. The simultaneous use of a plurality or all of these measures is particularly advantageous. The uniform flow improves the heat transfer and increases the operational reliability of the condenser section.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An apparatus for fractionating a gas mixture at low temperature, comprising:

a separation column;

a heat-exchanger block comprising a main heat-exchanger section and a condenser/evaporator section, wherein the condenser/ evaporator section comprises evaporation passages and condensation passages;

a first feed gas line for supplying feed gas to the main heat-exchanger section;

a second feed gas line for introducing cooled feed gas into the separation column;

a first liquid line leading from a lower region of the separation column to an inlet of the evaporation passages;

a gas line that leads from an upper region of the separation column to the condensation passages;

a reflux line to introduce condensate which is formed in the condensation passages into the upper region of the separation column;

a phase-separation device connected to an outlet of the evaporation passages; and a second liquid line leading from the phase-separation device to an inlet of the evaporation passages and also connected to a purge line.

2. An apparatus according to claim 1, wherein the heat-exchanger block comprises at least one group of passages that extend through the main heat-exchanger section and the condenser/evaporator section without interruption.

3. An apparatus according to claim 1, wherein the heat-exchanger block further comprises at least one group of passages that are interrupted between the main heat-exchanger section and the condenser/evaporator section.

4. An apparatus according to claim 1, wherein the phase-separation device comprises a pair of laterally disposed headers.

5. An apparatus according to claim 1, wherein the first liquid line opens centrally into a distribution device at the inlet of the evaporation passages.

6. An apparatus according to claim 5, wherein the distribution device is a bubble distributor.

7. An apparatus according to claim 1, wherein the gas line is connected to the upper region of the condensation passage.

8. A process for fractionating a gas mixture at low temperature, comprising:

cooling a feed gas in a main heat-exchanger section to about the dew point of the feed gas;

feeding the cooled feed gas to a separation column;

withdrawing a gaseous first fraction from an upper region of the separation column;

condensing the gaseous first fraction in a condenser/evaporator section to form a condensate;

returning at least a part of the condensate into the separation column;

withdrawing a liquid second fraction from a lower region of the separation column;

partially vaporizing the liquid second fraction against the condensing gaseous first fraction in the condenser/evaporator section;

separating a proportion that remains in the liquid state downstream of the partial vaporization;

returning a first part of the proportion into the condenser/evaporator section; and withdrawing a second part of the proportion as purge liquid, wherein the main heat-exchanger section and the condenser/evaporator section form partial sections of an integrated heat-exchanger block.

9. A process according to claim 8, further comprising heating the vaporized portion of the liquid second fraction in the main heat-exchanger section.

10. A process according to claim 8, wherein the gas mixture is air.

11. A process according to claim 8, wherein said withdrawing of the second part is continuously or batchwise.

* * * * *